US007040380B1

(12) United States Patent
O'Brien

(10) Patent No.: US 7,040,380 B1
(45) Date of Patent: May 9, 2006

(54) BRACKET FOR MOTOR VEHICLE AIR CONDITIONER HEAT EXCHANGER

(75) Inventor: Stephen W. O'Brien, Fort Worth, TX (US)

(73) Assignee: Tripac, Inc., Forth Worth, TX (US)

( * ) Notice: Subject to any disclaimer, the term of this patent is extended or adjusted under 35 U.S.C. 154(b) by 0 days.

(21) Appl. No.: 10/920,512

(22) Filed: Aug. 18, 2004

(51) Int. Cl.
*F28F 9/007* (2006.01)

(52) U.S. Cl. ..... 165/67; 165/149

(58) Field of Classification Search ..... 165/67, 165/149

See application file for complete search history.

(56) References Cited

U.S. PATENT DOCUMENTS 5,348,079 A * 9/1994 Tanaka ..... 165/67
5,456,089 A 10/1995 O'Brien
5,509,276 A 4/1996 O'Brien
5,535,819 A * 7/1996 Matsuura ..... 165/149
5,685,364 A 11/1997 Harris
5,697,431 A 12/1997 Nagasaka
6,405,788 B1 * 6/2002 Balthazard ..... 165/67
6,513,579 B1 * 2/2003 Kent et al. ..... 165/67
2002/0003034 A1 * 1/2002 Fukuoka et al. ..... 165/67
2002/0056541 A1 * 5/2002 Kokubunji et al. ..... 165/67
2005/0092461 A1 * 5/2005 Kroetsch et al. ..... 165/67

* cited by examiner

*Primary Examiner*—Allen J. Flanigan
(74) *Attorney, Agent, or Firm*—Bracewell & Giuliani LLP

(57) ABSTRACT

A motor vehicle air conditioner heat exchanger has two spaced apart parallel headers joined by two spaced apart parallel channel members. Flow tubes extend between the headers. A nonmetallic bracket is mounted at each of the corners. Each of the brackets has a socket that slides over one of the headers. Each of the brackets has a flange that slides over one of the channel members. The flange has a resilient tab that snaps into engagement with an edge of one of the channel members to retain the bracket.

18 Claims, 4 Drawing Sheets

BRACKET FOR MOTOR VEHICLE AIR CONDITIONER HEAT EXCHANGER

FIELD OF THE INVENTION

The invention relates in general to heat exchangers, and in particular to a motor vehicle air conditioner condenser having brackets for mounting the condenser to a motor vehicle and for mounting equipment to the condenser.

BACKGROUND OF THE INVENTION

Air conditioners for motor vehicles have two heat exchangers, one being an evaporator and the other being a condenser. The condenser is preferably located in front of and parallel to the engine radiator. The condenser may be either a parallel flow type or a serpentine flow type. In the parallel flow type, a plurality of parallel flow tubes extend between vertical tubular headers. The headers are in fluid communication with the refrigerant flowing through the flow tubes. Fins are located between each of the flow tubes for enhancing heat exchange. Typically, a frame member is located at the upper edge and at the lower edge, the frame members extending between upper and lower ends of the headers. Condensers are made of aluminum and fabricated by assembling the headers, flow tubes, fins, and frame members in a fixture, then passing the assembly through a brazing furnace.

Brackets are needed to secure components to the heat exchanger and also to mount the heat exchanger in the motor vehicle. Because of the differences in vehicles, the brackets have a variety of shapes and fit to the heat exchanger at different places. The brackets may be secured by rivets or threaded fasteners to the heat exchanger. Alternately, they may be brazed in place when the heat exchanger passes through the brazing furnace. Installing the brackets at the appropriate positions can be a time-consuming process.

SUMMARY OF THE INVENTION

In this invention, a bracket is mounted to at least one of the corners of the heat exchanger. The bracket has a socket portion with a transverse cross-section that mates with and slides over one of the elongated members in a direction parallel to the axis of the elongated member. The bracket has a flange portion that is joined to the socket portion that has spaced apart flange walls. The flange walls slide over a second one of the elongated members of the heat exchanger in a direction perpendicular to an axis of the second one of the elongated members. A mounting member formed on the bracket protrudes from the bracket for mounting components to the heat exchanger or mounting the heat exchanger to a motor vehicle.

Preferably, the flange portion has a pair of resilient tabs. These tabs snap into engagement with portions of the second elongated member to retain the bracket on the corner. Optionally, fasteners, such as rivets, may be inserted through the bracket and into the elongated members.

DETAILED DESCRIPTION OF THE INVENTION

Figure 1:
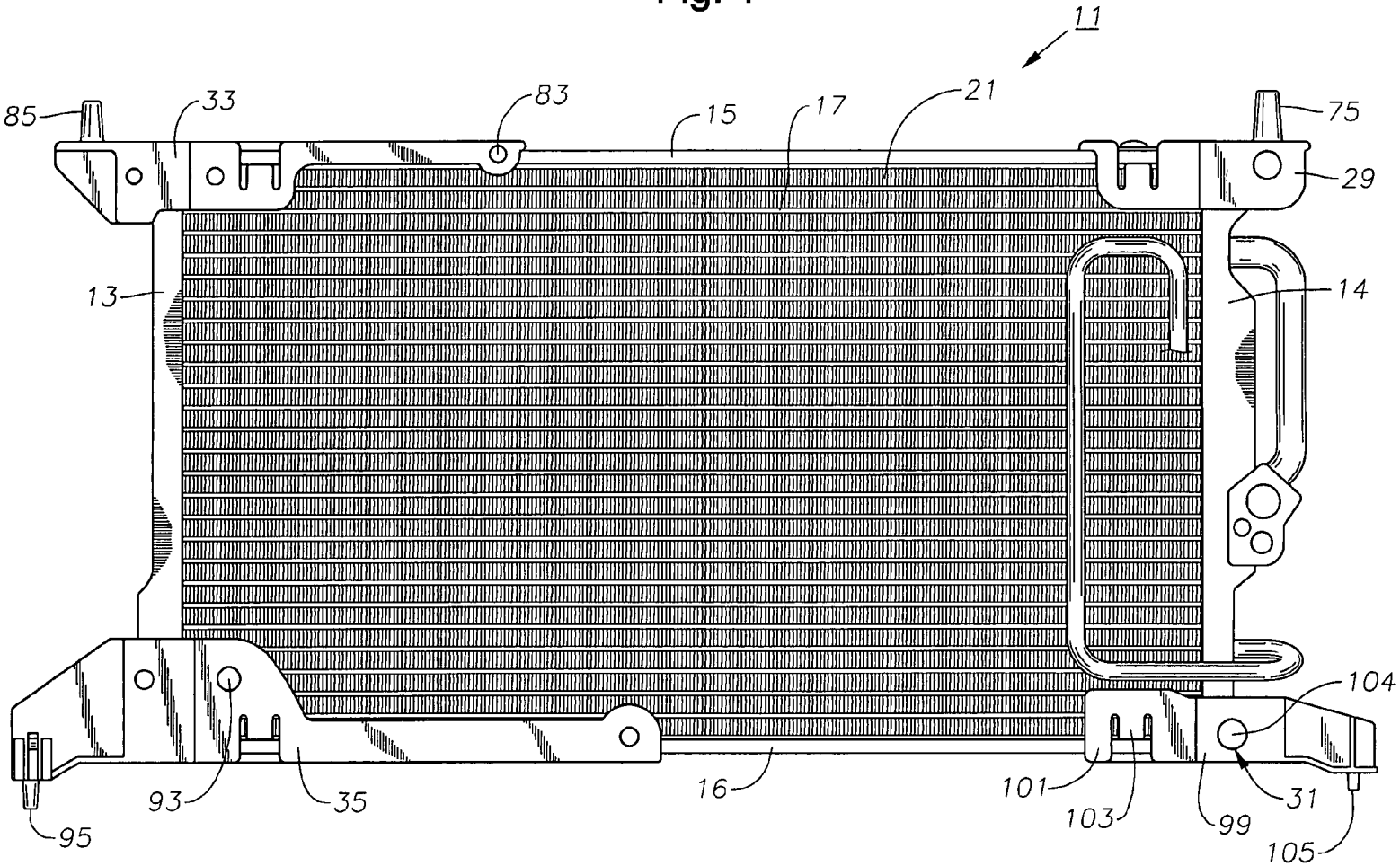
FIG. 1 is an elevational view of the back side of an automotive air conditioner condenser with brackets constructed in accordance with the invention and with various components removed.

Referring to FIG. 1, condenser 11 is shown as a parallel flow type, although it could be a serpentine flow type. Condenser 11 has two headers 13, 14 that are spaced apart from and parallel to each other. Headers 13, 14 are elongated tubular members that may be of various transverse cross-sections, such as rectangular, elliptical, circular or other shapes. Headers 13, 14 are joined by elongated members 15, 16, which serve as frame members and may be of various transverse cross-sections. In this embodiment, frame members 15, 16 comprise channel members. A plurality of flow tubes 17 extend between headers 13, 14 parallel to channel members 15, 16. Flow tubes 17 are flat tubular members having a plurality of passages within them for communicating refrigerant between headers 13 and 14. Fins 19 extend between each of the flow tubes 17, 19 for enhancing heat exchange.

Figure 2:
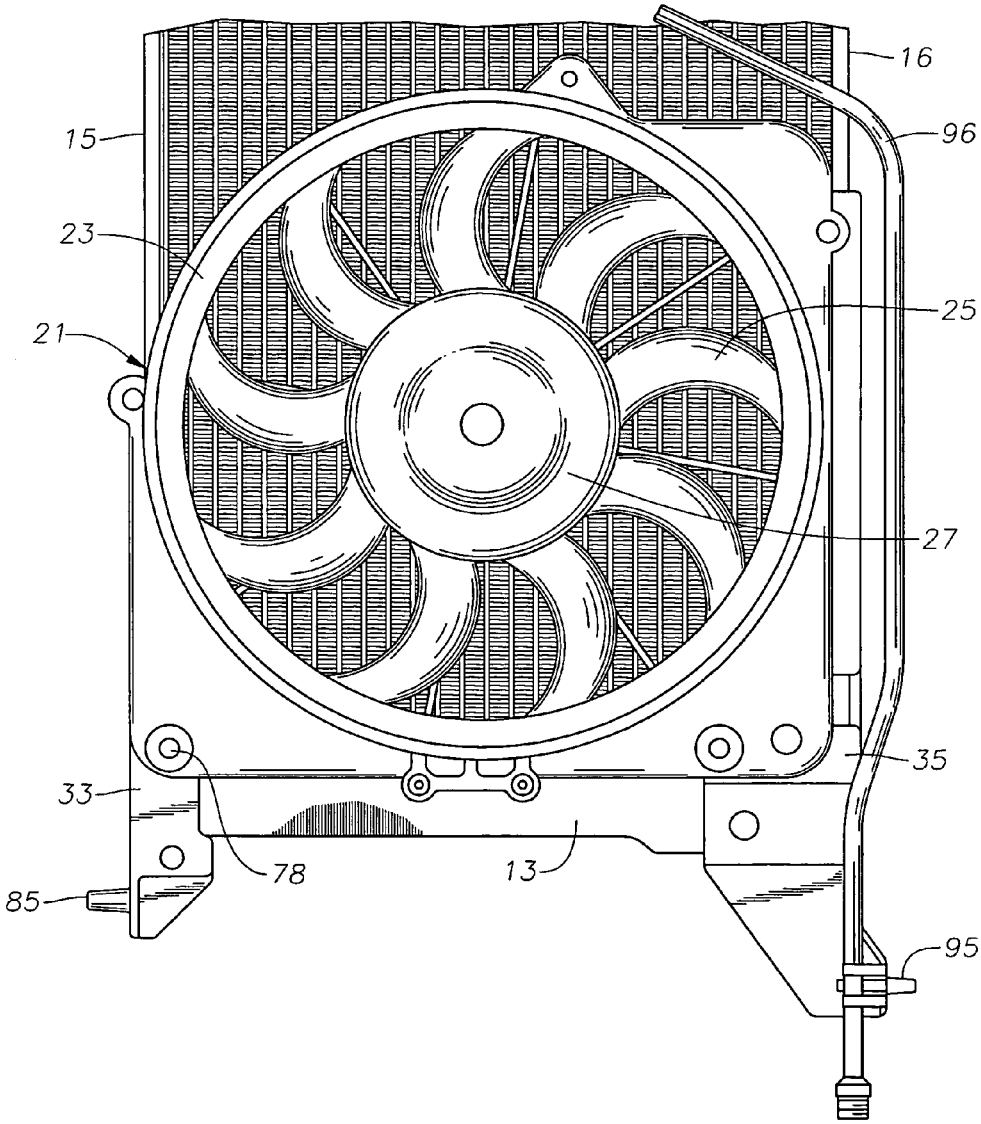
FIG. 2 is an elevational view of a portion of the back side of the condenser of FIG. 1, showing a fan assembly installed.

Various components are mounted to the back side of condenser 11, such as a receiver (not shown) and a fan assembly 21, which is shown in FIG. 2. Fan assembly 21 has a fan cowling 23 that encloses a fan 25. An electrical motor 27 rotates fan 25 within fan cowling 23.

Referring again to FIG. 1, an upper right bracket 29 is secured at the corner of upper channel member 15 and right side header 14. A lower right bracket 31 is located at the corner formed by lower channel member 16 and right side header 14. An upper left bracket 33 is located at the corner formed by upper channel member 15 and left side header 13. A lower left bracket 35 is located at the corner formed by lower channel member 16 and left side header 13. Brackets 29, 31, 33, 35 are configured to slide over and be frictionally retained to the corners of condenser 11. In this embodiment, brackets 29, 31, 33 and 35 differ from each other. However, each has common features. Brackets 29, 31, 33, 35 are preferably installed after condenser 11 has passed through a brazing furnace. Also, preferably, brackets 29, 31, 33, 35 are formed of a non-metallic material, such as plastic, and molded in an injection-molding process.

Figure 4:
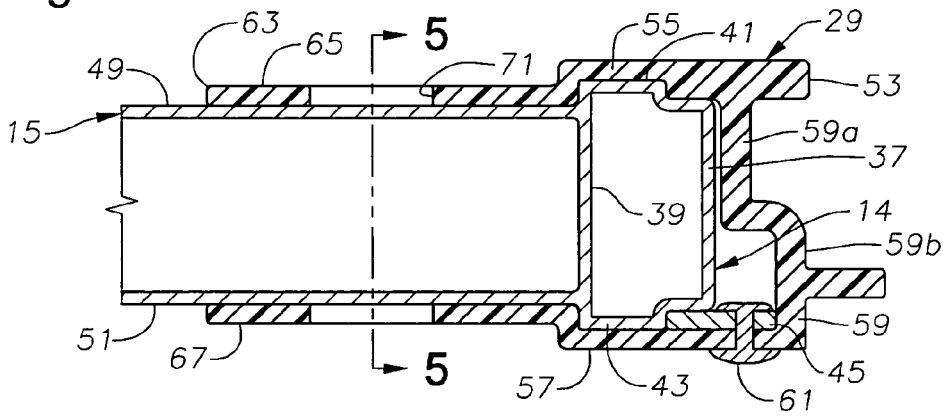
FIG. 4 is a sectional view of the bracket of FIG. 3, taken along the line 4—4 of FIG. 3.

Referring to FIG. 4, in this embodiment, the transverse cross-sectional shape of each header 13, 14 is generally rectangular. FIG. 4 shows the cross-sectional shape of right side header 14, the shape of left side header 13 being the same. Header 14 has two spaced apart side end walls 37, 39 that are parallel to each other. Front and back walls 41, 43 join side end walls 37, 39 to provide a generally rectangular configuration. In this embodiment, header front and back walls 41, 43 have offset portions. Although header 13 is shown as a single integral member in this embodiment for clarity, side end wall 37 and the offset portions of front and back walls 41, 43 are initially separate from side end wall 39 and the adjoining portions of front and back walls 41, 43. The separate halves of header 13 are brazed together in a brazing furnace in this embodiment. Also, preferably an integral flange 45 extends laterally outward from back wall 43 parallel to back wall 43.

Figure 5:
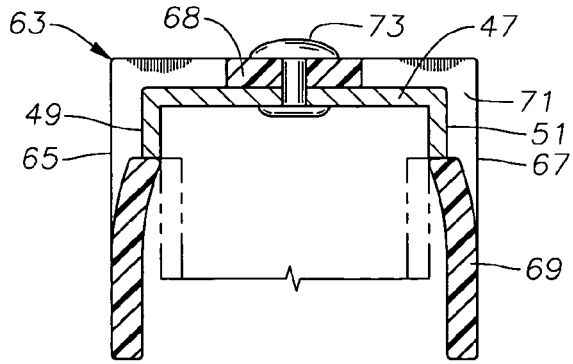
FIG. 5 is a sectional view of the bracket of FIG. 3, taken along the line 5—5 of FIG. 3.

In the example shown, header channel member 15 has a channel base 47 with front and back walls 49, 51 as shown in FIG. 5. Walls 49, 51 of upper channel member 15 face downward, while the corresponding walls of lower channel member 16 (FIG. 1) face upward. The right end of upper channel member 15 abuts header side wall 39 and is brazed to it in the brazing furnace.

Figure 3:
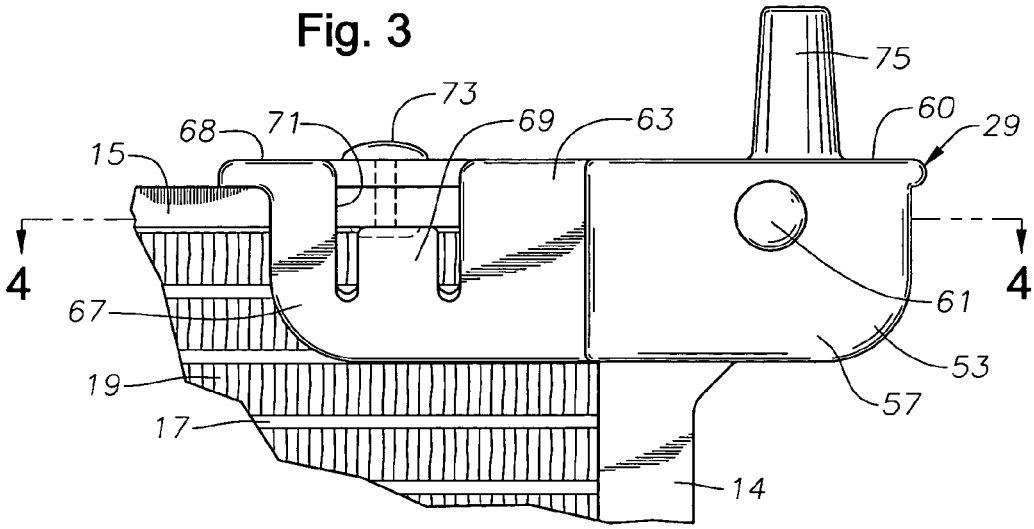
FIG. 3 is a back view of the upper right bracket of the condenser of FIG. 1.

Referring to FIGS. 3 and 4, upper right bracket 29 has a socket portion 53 that has a transverse cross-section for close sliding reception over the upper end of right side header 14. Socket portion 53 has a front wall 55, a back wall 57, and a side end wall 59. Front and back walls 55, 57 are parallel to each other and perpendicular to side end wall 59. Side end wall 59 has two portions, 59*a*, 59*b*, that are offset but located in parallel planes. As shown in FIG. 4, bracket front wall 55 slidingly engages header front wall 41, and bracket back wall 57 slidingly engages header back wall 43. Bracket side end wall portion 59*a* slidingly engages a portion of header side end wall 37. Bracket side end wall portion 59*b* accommodates flange 45. Upper right bracket 29 has a base 60 that lands on the upper end of right header 14. After sliding bracket 29 onto header 14, the assembler optionally may install a fastener such as rivet 61 through a preformed hole in socket portion back wall 57 and into right side header flange 45.

Bracket 29 also has a flange portion 63 that extends laterally from socket portion 53. Flange portion 63 comprises a front wall 65 and a back wall 67 that are parallel to each other and extend downward the same length as socket portion front and back walls 55, 57. Front and back walls 65, 67 of flange portion 63 are in parallel planes to front and back walls 55, 57 of socket portion 53. A base 68 joins front and back walls 65, 67 and lands on base 47 of upper channel member 15.

A pair of tabs 69 are preferably formed in flange walls 65, 67. Each tab 69 is resilient and has an upper end that is biased inward, as shown in FIG. 5. Each tab 69 is formed in a cutout 71 in its respective wall 65 or 67. The upper edge of each tab 69 snaps inward below the lower edges of channel walls 49, 51, as shown in FIG. 5 to hold bracket 29 in place. After installation of bracket 29 on header 14 and channel member 15, the assembler may optionally install a fastener such as rivet 73 through a preformed hole in base 68 and into channel member base 47 (FIG. 5).

Bracket 29 has an integral mounting pin 75 that extends from it for mounting condenser 11 within a motor vehicle. In this embodiment, mounting pin 75 is a cylindrical rod or protuberance that protrudes upward along an axis that is parallel to right side header 14.

Figure 7:
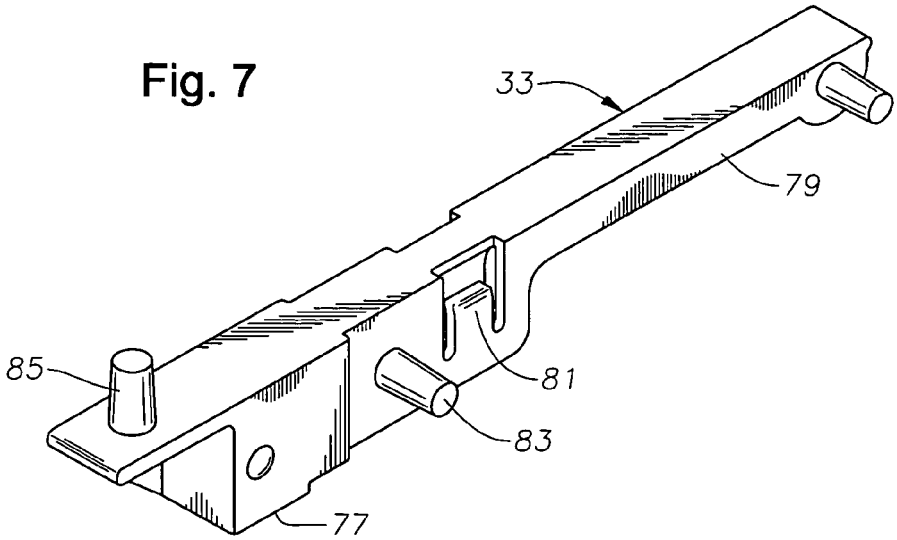
FIG. 7 is a perspective view of the upper left bracket shown in FIG. 1.

FIG. 7 illustrates the back side of upper left bracket 33. Bracket 33 also has a socket portion 77 and a flange portion 79 extending laterally therefrom. Socket portion 77 is configured in the same manner as socket portion 53 of upper right bracket 29 for sliding over the upper end of left header 13. Flange portion 79 has the same general configuration as flange portion 63 of upper right bracket 29, but it is longer. Two spaced-apart fastener receptacles 83 are located on the back side of flange portion 79. Receptacles 83 are threaded in this embodiment and protrude rearward, parallel to each other. Receptacles 83 are positioned to receive fasteners 78 (FIG. 2) for fastening the upper edge of cowling 23 to upper left bracket 33. Upper left bracket 33 also has a mounting pin 85 that protrudes upward. Tabs 81 on upper left bracket 33 engage upper channel member 15 (FIG. 1).

Referring to FIG. 8, lower left bracket 35 has a socket portion 87 that slides over the lower end of left header 13. A flange portion 89 extends laterally from socket portion 87 for sliding over lower channel member 16 (FIG. 1). Flange portion 89 in this embodiment is even longer than flange portion 79 (FIG. 7) of upper left bracket 33, but this is not critical. Flange portion 89 has tabs 91 for retaining bracket 35 as well as a preformed hole 92 in socket portion 87 for receiving a rivet. Lower left bracket 35 has a pair of threaded receptacles 93 that are on the back wall of flange 89 and face rearward for securing the lower end of fan assembly 21 (FIG. 2). A mounting member 95 protrudes downward from lower left bracket 35. Lower left bracket 35 in this embodiment also has a hook 97 located on its back side for retaining a tube 96 (FIG. 2) that leads to a receiver (not shown) that is mounted to condenser 11.

Referring to FIG. 1, lower right bracket 31 has a socket 99 that slidingly receives the lower end of right header 14. A flange 101 extends laterally from socket 99 for sliding over channel member 16. Tabs 103 in flange 101 snap into engagement with the upper edges of channel member 16. An optional rivet 104 extends into flange 45 (FIG. 2) of right header 14. A mounting member 105 protrudes downward from lower right bracket 31.

Figure 6:
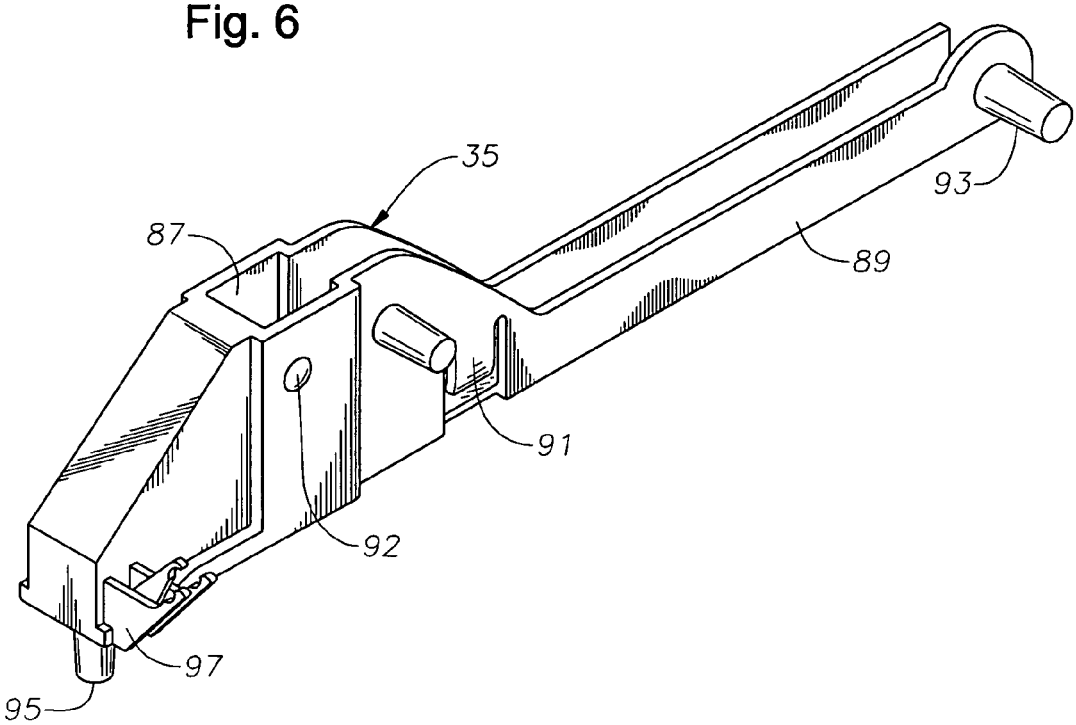
FIG. 6 is a perspective view of the lower left bracket shown in FIG. 1

During assembly, each condenser 11 is separately assembled in a fixture with headers 13, 14, channel members 15, 16, flow tubes 17, and fins 19. The assembly and fixture pass through a brazing furnace to braze the components together. Brackets 29, 31, 33 and 35 are preferably formed by an injection molding process. After condenser 11 has passed through the brazing furnace, an assembler will slide upper right bracket 29 over the corner between upper channel 15 and right header 14. Tabs 69 snap into engagement with upper channel member 15. Holes for rivets 61 and 73 are preferably preformed. Thus, the operator simply installs the rivets to permanently secure bracket 29 in place. A similar procedure is followed with brackets 31, 33 and 35. The assembler places fan assembly 21 in the position shown in FIG. 2 and inserts fasteners 78 into threaded receptacles 83 (FIG. 7) and 93 (FIG. 6). Condenser 11 is installed in a motor vehicle in a conventional manner.

The invention has significant advantages. A variety of different mounting brackets can be fitted to the same size of condenser, enabling one size of a condenser to fit a number of different vehicles. The mounting brackets snap readily into place and are quick to install. Injection molding the brackets allows complex shapes to be formed in large quantities at inexpensive prices.

While the invention has been shown in only one of its forms, it should be apparent to those skilled in the art that it is not so limited but is susceptible to various changes without departing from the scope of the invention.

The invention claimed is:

1. In a motor vehicle air conditioner heat exchanger having horizontal and vertical elongated members that are joined to each other at their ends, defining four corners, at least one fluid carrying tube mounted to the elongated members, and a fin in engagement with the tube for enhancing heat exchange, the improvement comprising a bracket mounted to at least one of the corners, comprising:

a socket portion with a transverse cross-section that mates with and slides over a first one of the elongated members in a direction parallel to an axis of the first one of the elongated members;

a flange portion joined to the socket portion and having spaced apart flange walls that slide over a second one of the elongated members in a direction perpendicular to an axis of the second one of the elongated members;

a mounting member formed on the bracket and protruding therefrom; and at least one resilient tab formed in one of the flange walls of the flange portion for snapping into engagement with a portion of the second one of the elongated members.

2. The heat exchanger of claim 1, further comprising at least one fastener that inserts through the bracket and a portion of one of the elongated members.

3. The heat exchanger of claim 1, wherein said at least one resilient tab comprises a pair of resilient tabs, each of the tabs being formed in one of the flange walls of the flange portion for snapping into engagement with portions of the second one of the elongated members.

4. The heat exchanger of claim 1, wherein the socket portion has a side end wall portion, a front wall portion and a back wall portion, each of the wall portions being flat, the front and back wall portions being parallel to each other and perpendicular to the side end wall portion.

5. The heat exchanger of claim 1, wherein the flange walls of the flange portion are flat and parallel to each other for slidingly engaging front and back walls of the second one of the elongated members.

6. The heat exchanger of claim 1, wherein the bracket has at least one threaded receptacle on a rearward side; and the heat exchanger further comprising:

a fan cowling; and a fastener extending from the fan cowling into the threaded receptacle.

7. The heat exchanger of claim 1, wherein:

the socket portion has a side end wall portion, a front wall portion and a back wall portion, each of the wall portions being flat, the front and back wall portions being parallel to each other and perpendicular to the side end wall portion;

the flange walls of the flange portion are flat and parallel to each other;

one of the flange walls is in a plane parallel to the front wall portion of the socket portion; and the other of the flange walls is in a plane parallel to the back wall portion of the socket portion.

8. In a motor vehicle air conditioner heat exchanger having parallel first and second headers joined by parallel first and second frame members, defining four corners, at least one flow tube extending between and in fluid communication with the headers, a bracket mounted at the corner between the first header and the first frame member, comprising:

a socket portion with a transverse cross-section that slidingly mates with and slides over the first header in a direction parallel to an axis of the first header;

a flange portion joined to and extending laterally from the socket portion, the flange portion having spaced apart flange walls that slide over the first frame member in a direction perpendicular to the axis of the first header;

a resilient tab formed in at least one of the flange walls of the flange portion, the tab snapping into engagement with the first frame member to retain the bracket on the heat exchanger; and a mounting pin formed on the bracket and protruding therefrom in a direction parallel to the axis of the first header for mounting the heat exchanger to a motor vehicle.

9. The heat exchanger of claim 8, further comprising at least one fastener that inserts through the flange portion and into the first frame member.

10. The heat exchanger of claim 8, wherein:

the first frame member comprises a channel member having a base and front and back walls extending therefrom; and the resilient tab engages an edge of one of the walls of the channel member.

11. The heat exchanger of claim 8, wherein:

the first header has front and back wall portions that are flat and parallel with each other, and a side end wall portion that is flat and perpendicular to the front and back wall portions; and the socket portion has front and back wall portions that are flat and parallel with each other, and a side end wall portion that is flat and perpendicular to the front and back wall portions of the socket portion.

12. The heat exchanger of claim 8, wherein the bracket has at least one threaded receptacle on a back side; and the heat exchanger further comprising:

a fan cowling; and a fastener extending from the fan cowling into the threaded receptacle.

13. The heat exchanger of claim 8, wherein:

the socket portion has a side end wall portion, a front wall portion and a back wall portion, each of the wall portions being flat, the front and back wall portions being parallel to each other and perpendicular to the side end wall portion;

the flange walls of the flange portion are flat and parallel to each other;

one of the flange walls is in a plane parallel to the front wall portion of the socket portion; and the other of the flange walls is in a plane parallel to the back wall portion of the socket portion.

14. A motor vehicle air conditioner heat exchanger, comprising:

two spaced-apart parallel headers, each having an axis;

two spaced-apart parallel channel members, each of the channel members having a base and front and back walls extending from the base, the channel members having ends joined to ends of the headers, defining four corners;

a plurality of flow tubes extending between and in fluid communication with the headers;

a nonmetallic bracket mounted at each of the corners, each of the brackets comprising:

a socket portion with a side end wall portion and front and back wall portions that are parallel to each other and perpendicular to the side end wall portion, the socket portion sliding over an end of one of the headers;

a flange portion joined to and extending laterally from the socket portion, the flange portion having a base with front and back wall portions that are parallel to each other and extend from the base, the front and back wall portions of the flange portion sliding over the front and back walls of one of the channel members, and the base of the flange portion overlying the base of said one of the channel members;

a resilient tab formed in each of the front and back wall portions, the tabs having free ends that snap into engagement with edges of the front and back walls of said one of the channel members to retain the bracket on the heat exchanger; and a mounting pin formed on the bracket and protruding therefrom in a direction parallel to the axes of the headers for mounting the heat exchanger to a motor vehicle.

15. The heat exchanger of claim 14, further comprising at least one fastener that inserts through the base of the flange portion and into engagement with the base of said one of the channel members.

16. The heat exchanger of claim 14, further comprising:

a flange extending from each of the headers, wherein the socket portion slides over an end portion of the flange; and a fastener extending from one of the wall portions of the socket portion into engagement with the flange.

17. The heat exchanger of claim 14, further comprising:

a fan cowling; and threaded receptacles located on two of the brackets and facing rearward for receiving fasteners to secure the fan cowling to the heat exchanger.

18. The heat exchanger of claim 14, wherein the front and back wall portions of the socket portion are parallel with the front and back wall portions of the flange portion.

* * * * *